US009868559B2

(12) United States Patent
Li et al.

(10) Patent No.: US 9,868,559 B2
(45) Date of Patent: Jan. 16, 2018

(54) LABEL STICKING DEVICE AND APPARATUS

(71) Applicants: Tyco Electronics (Shanghai) Co. Ltd., Shanghai (CN); Tyco Electronics Corporation, Berwyn, PA (US); Suzhou Hanchuan Co., Ltd., Suzhou, Jiangsu Province (CN)

(72) Inventors: Zhiguo Li, Shanghai (CN); Dandan Zhang, Shanghai (CN); George Dubniczki, Berwyn, PA (US); Roberto-Francisco Lu, Berwyn, PA (US); Huiyou Zhou, Suzhou (CN)

(73) Assignees: TE Connectivity Corporation, Berwyn, PA (US); Suzhou Hanchuan Co., Ltd., Suzhou (CN); Tyco Electronics (Shanghai) Co. Ltd., Shanghai (CN)

( * ) Notice: Subject to any disclaimer, the term of this patent is extended or adjusted under 35 U.S.C. 154(b) by 436 days.

(21) Appl. No.: 14/699,067

(22) Filed: Apr. 29, 2015

(65) Prior Publication Data

US 2015/0307221 A1 Oct. 29, 2015

(30) Foreign Application Priority Data

Apr. 29, 2014 (CN) ..... 2014 1 0185965

(51) Int. Cl.
*B65C 3/02* (2006.01)

(52) U.S. Cl.
CPC ..... *B65C 3/02* (2013.01)

(58) Field of Classification Search
CPC ..... B65C 3/02
See application file for complete search history.

(56) References Cited

U.S. PATENT DOCUMENTS

2004/0211522 A1* 10/2004 Fries ..... B65C 3/02 156/443

* cited by examiner

*Primary Examiner* — Jeff Aftergut
(74) *Attorney, Agent, or Firm* — Barley Snyder

(57) ABSTRACT

A label sticking device has a shaft, a cable holder, a drive, a press, and an actuator. The shaft has a rotational axis, and a cable receiving passageway extending along a longitudinal axis aligned with the rotational axis. The cable holder is positioned along the longitudinal axis and the rotational axis. The drive rotates the shaft about the rotational axis. The press has a body rotatably connected to the shaft, and a foot positioned on the body. The foot is movable between a pressing position proximate to the rotational axis, and a non-pressing position distal to the rotational axis. The actuator moves the press between the pressing position and the non-pressing position.

21 Claims, 6 Drawing Sheets

LABEL STICKING DEVICE AND APPARATUS

CROSS-REFERENCE TO RELATED APPLICATIONS

This application claims the benefit of the filing date under 35 U.S.C. §119(a)-(d) or (f) to Chinese Patent Application No. 201410185965.2, filed on Apr. 29, 2014.

FIELD OF THE INVENTION

The invention is generally related to a label sticking device and apparatus, and, more specifically, to a label sticking device and apparatus for sticking a label around an electrical cable.

BACKGROUND

Conventionally, sticking a label around a cable is generally performed manually. An operator needs to manually wrap a long label around the cable by a number of concentric circles, which requires a large amount of manual labor by the operator. Furthermore, during the process of wrapping of the label around the cable, it is very difficult for the operator to consistently provide an equal operational force on the label, and the label is often not uniformly wrapped on the cable.

SUMMARY

The present invention has been made to overcome or alleviate at least one aspect of the above mentioned disadvantages.

A label sticking device has a shaft, a cable holder, a drive, a press, and an actuator. The shaft has a rotational axis, and a cable receiving passageway extending along a longitudinal axis aligned with the rotational axis. The cable holder is positioned along the longitudinal axis and the rotational axis. The drive rotates the shaft about the rotational axis. The press has a body rotatably connected to the shaft, and a foot positioned on the body. The foot is movable between a pressing position proximate to the rotational axis, and a non-pressing position distal to the rotational axis. The actuator moves the press between the pressing position and the non-pressing position.

BRIEF DESCRIPTION OF THE DRAWINGS

The invention will now be described by way of example, with reference to the accompanying drawings, of which.

DETAILED DESCRIPTION OF THE EMBODIMENT(S)

Figure 1:
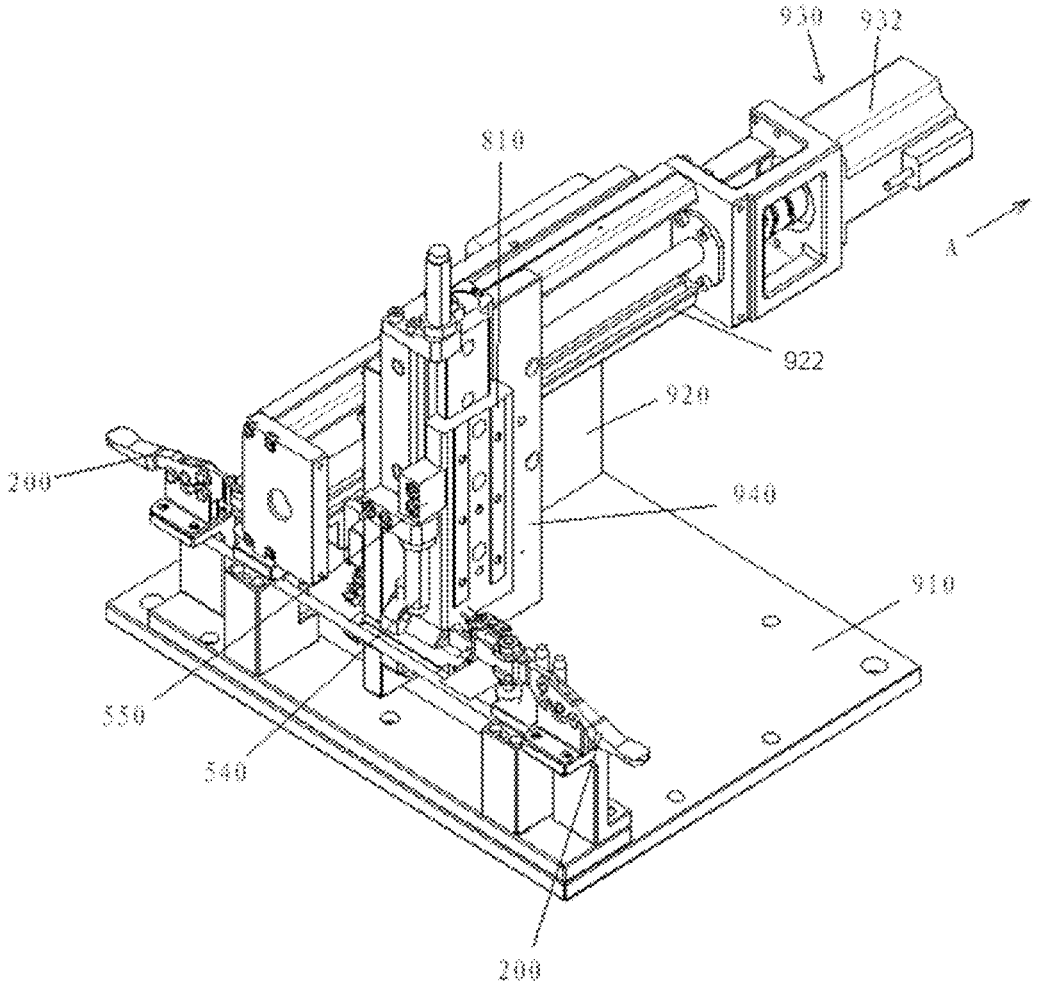
FIG. 1 is a perspective view of a label sticking device.
Figure 2:
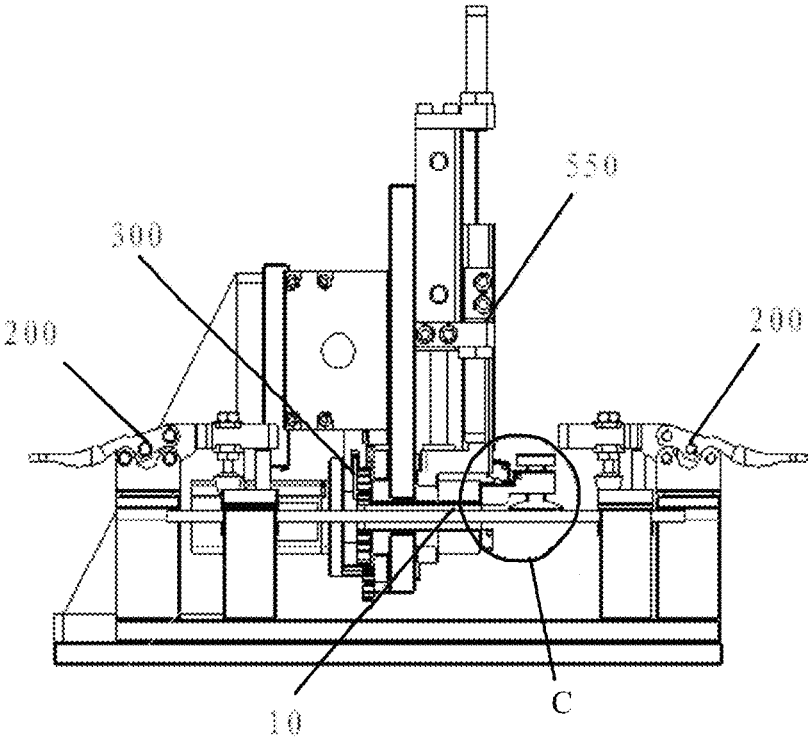
FIG. 2 is a side view of the label sticking device.

Exemplary embodiments of the invention will be described hereinafter in detail with reference to the attached drawings, wherein the like reference numerals refer to the like elements. The invention may, however, be embodied in many different forms and should not be construed as being limited to the embodiment set forth herein; rather, these embodiments are provided so that the disclosure will be thorough and complete, and will fully convey the concepts of the invention to those skilled in the art.

In the following detailed description, for purposes of explanation, numerous specific details are set forth in order to provide a thorough understanding of the exemplary embodiments. It will be apparent, however, that one or more embodiments may be practiced without these specific details. In other instances, well-known structures and devices are schematically shown in order to simplify the drawing.

In the embodiments shown in FIGS. 1-4, and 6, a label sticking device has a shaft 100, a cable holder 200, a drive 300, a press 400, and a actuator 500.

The shaft 100 has a cable receiving passageway 110, where a rotational axis of the shaft 100 is in conformity with a longitudinal axis of a cable (not shown) positioned in the cable receiving passageway 110.

The cable holder 200 holds the cable, so that the longitudinal axis of the cable is in conformity with the rotational axis of the shaft 100.

The drive 300 drives the shaft 100 to rotate about the rotational axis.

Figure 3:
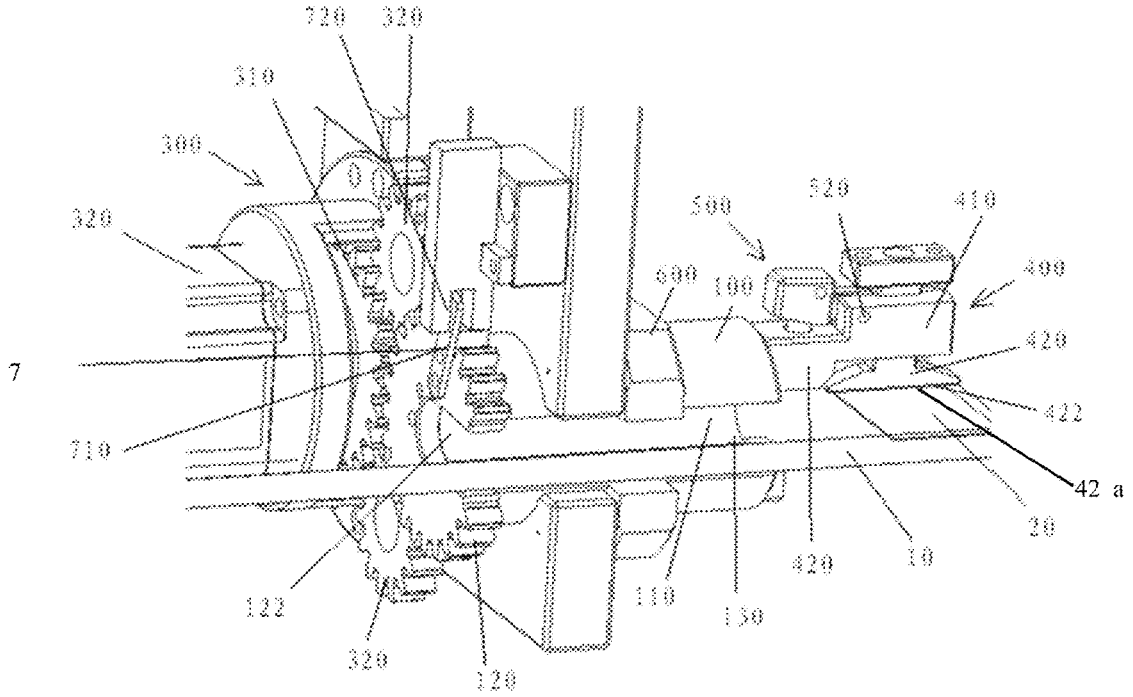
FIG. 3 is an enlarged perspective view of a shaft, a drive, a press and a part of a actuator of the label sticking device.
Figure 6:
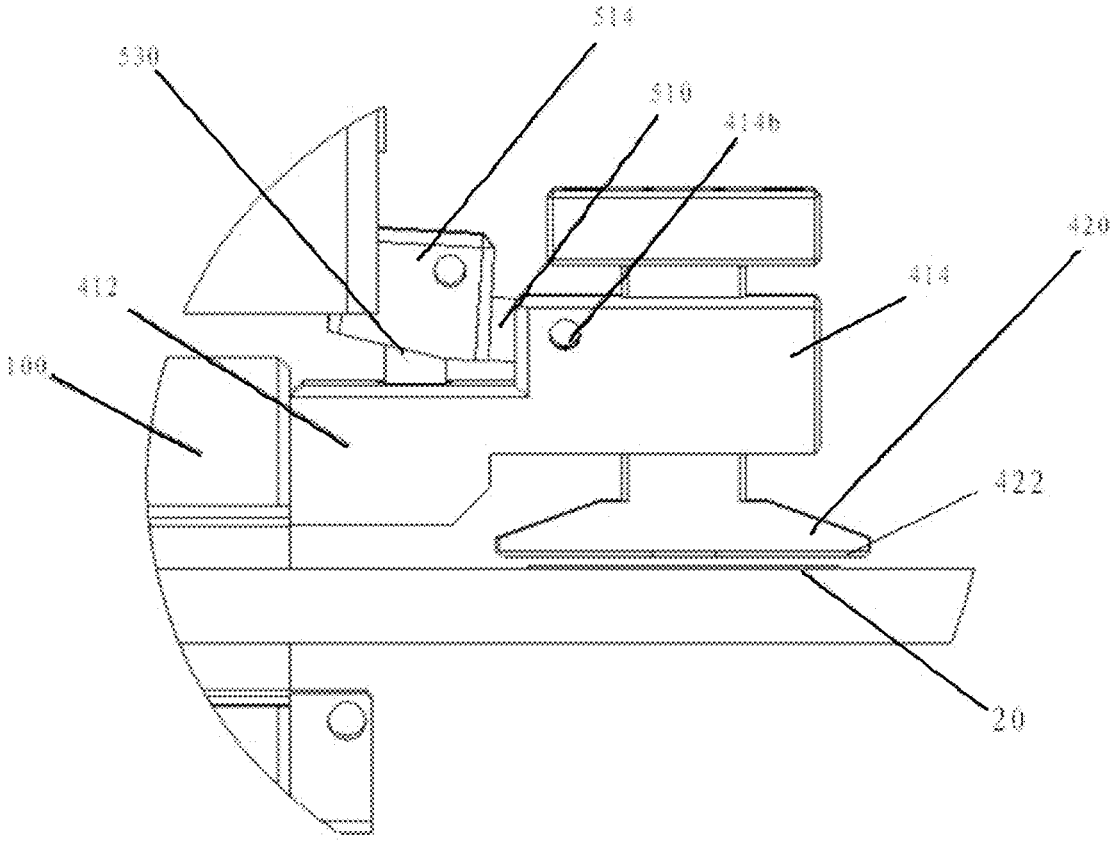
FIG. 6 is an enlarged side view of part C shown in FIG. 2.

The press 400 is connected to the shaft 100 to rotate with the shaft 100. The press 400 has a body 410 connected to the shaft 100 and a foot 420 positioned on the body 410. The foot 420 is movable between a pressing position (a position as shown in FIG. 6) where the foot 420 presses the label 20 on the cable 10, and a non-pressing position (a position as shown in FIG. 3) where the foot 420 is separate from the label on the cable. When the foot 420 in the pressing position, the label 20 is pressed on the cable 10 as the shaft 100 rotates. Therefore when the foot 420 is in the pressing position, the foot 420 is positioned proximate to the rotational axis, and when the foot 420 is in the non-pressing position, the foot 420 is positioned distal to the rotational axis.

The actuator 500 moves the foot 420 between the pressing position and the non-pressing position.

In the embodiments shown in FIGS. 1-4 and 6, the cable holder 200 is a cable clamp. However, in other embodiments the cable holder 200 may be any suitable member adapted to hold the cable 10 in conformity with the rotational axis in the longitudinal direction, and being adapted to hold various cables with different diameters.

In an embodiment shown in FIG. 3, the shaft 100 has a cylindrical body with a driven gear 120 and a hollow, centrally located member defining the cable receiving passageway 110. The drive 300 has a driving gear 310 configured to drive the driven gear 120 to rotate the cylindrical body of the shaft 100.

While the embodiment of FIG. 3 shows the shape of the shaft 100 to be approximately cylindrical in shape, those of ordinary skill in the art would appreciate that in other embodiments, the shape of the shaft 100 can be shapes other than cylindrical. For example, the shaft 100 may include a rod extending in the rotational axis (not shown). One end of the rod is mounted on the driven gear 120, and the other end of the rod is mounted on press 400. In another example, the shaft 100 may comprise two or more rods, and the press 400 is mounted on the driven gear 110 through the rod. When the shaft 100 includes the rod, the cable receiving passageway 110 may be a cylindrical space defined by rotating the rod about the rotational axis.

In an embodiment shown in FIG. 3, the cylindrical body of the shaft 100 has a longitudinally extending cable receiving slot 130 extending along the longitudinal axis, so as to permit the cable to enter into the cable receiving passageway 110 through the cable receiving slot 130. Further, the driven gear 120 has a cable receiving gear slot 122 extending from an outer circumferential edge to an approximate center of the driven gear 120. The cable receiving gear slot 122 is aligned with the cable receiving passageway 110 and the cable receiving slot 130, so as to permit the cable to be mounted in the cable receiving passageway 110 with the longitudinal axis of the cable conforming to the rotational axis.

In an embodiment, an approximate middle portion of the cable between two ends of the cable is positioned in the cable receiving passageway 110, with the two ends of the cable extending outside the cable receiving passageway 110. However, the invention is not limited to this configuration. For example, in another embodiment, only one end of the cable is positioned in the cable receiving passageway 110, and the cable receiving passageway 110 may not pass through the whole shaft 100 in the rotational axis. In another embodiment, the cable receiving slot 130 has been omitted. In yet another embodiment, the driven gear 120 may be not have the cable receiving gear slot 122. In embodiments where the longitudinal slot is not provided in the cylindrical body of the shaft 100, the cylindrical body may be driven to rotate by a strap or a toothed belt (not shown).

In an embodiment shown in FIG. 3, the driven gear 120 is positioned on one end of the cylindrical body of the shaft 100. In an embodiment (not shown), the driven gear 120 may be integrally formed on an outer circumferential surface of the cylindrical body.

Figure 5:
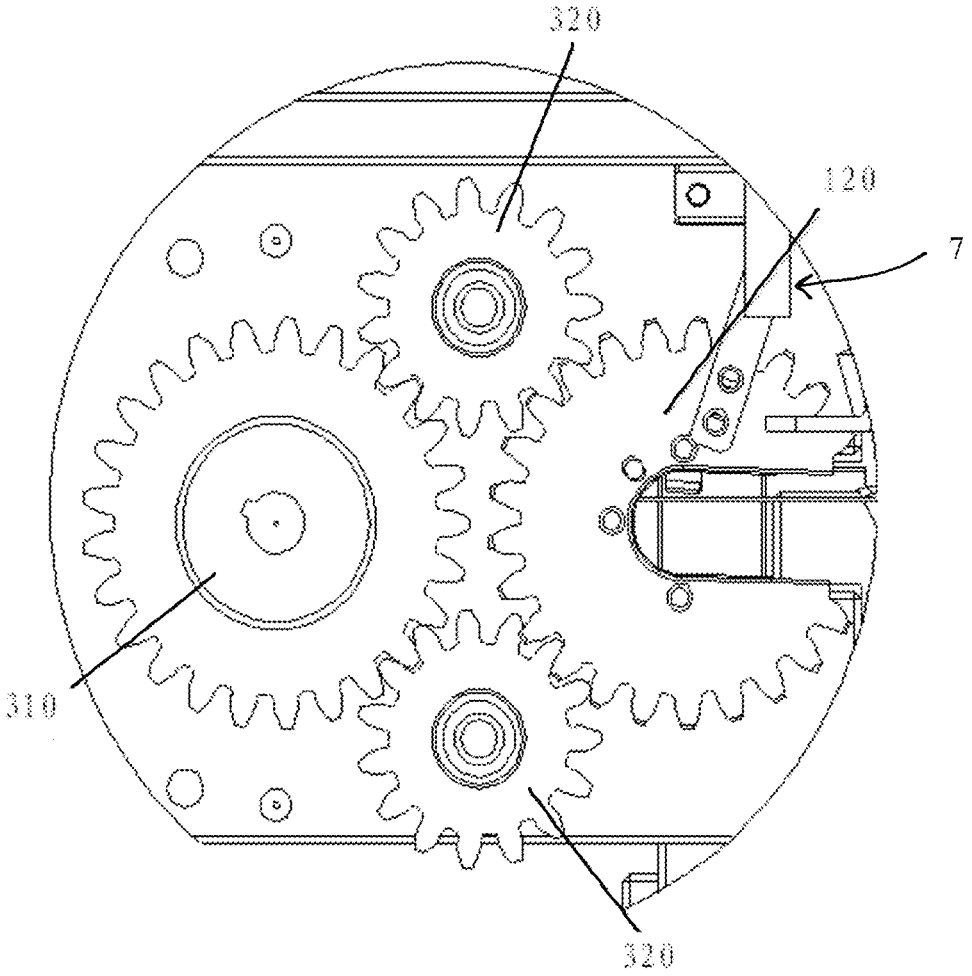
FIG. 5 is a perspective view gears in the drive.

When the cable receiving gear slot 122 is positioned in the driven gear 120, the driving gear 310 cannot engage with the driven gear 120 at the region of the cable receiving gear slot 122. In order to overcome this problem, as shown in the embodiments of FIGS. 3 and 5, the drive 300 further comprises two middle gears 320 positioned on opposite sides, respectively, of a line from a center of the driving gear 310 to a center of the driven gear 120. Each middle gear 320 is engaged with both the driving gear 310 and the driven gear 120. In this way, when one of the middle gears 320 is not engaged with the driven gear 120 due to the cable receiving gear slot 122, the other of the middle gears 320 is still engaged with the driven gear 120, ensuring the continuity of gear transmission.

Figure 4:
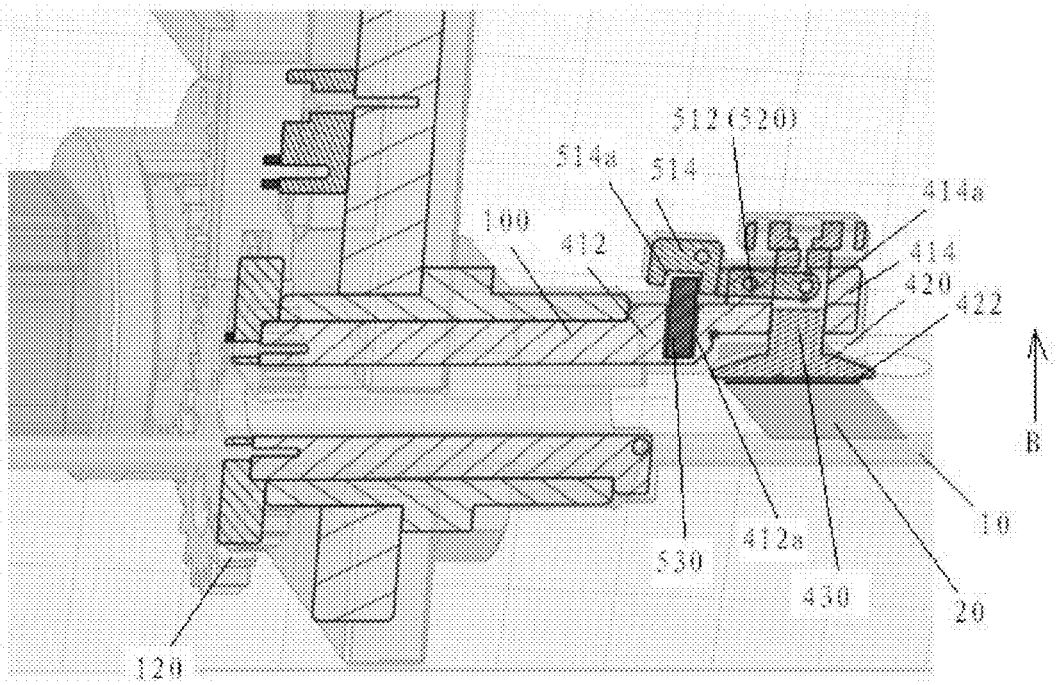
FIG. 4 is an enlarged cross-sectional view of the label sticking device of FIG. 3.

Those of ordinary skill in the art would appreciate that the driving gear 310 may be directly driven by the driving motor 320 (see FIGS. 3 and 4).

In an embodiment shown in FIG. 3, the label sticking device further comprises a bearing member 600 mounted on the cylindrical body of the shaft 100 to rotatably support the cylindrical body. The bearing member 600 and the driven gear 120 are positioned at different positions along the longitudinal axis. With the bearing member 600, the shaft 100 is more reliably supported. In an embodiment of the label sticking device that includes the cable receiving slot 130, a corresponding slot is also positioned in a respective location of the bearing member 600 to permit the cable to pass there through.

In an embodiment shown in FIGS. 3 and 5, the label sticking device further comprises an angle detection member 700 that detects an angle position of the shaft 100 and/or a number of rotational circles of the shaft 100 from starting; and a control member (not shown) configured to control the drive 300 based on a detection result of the angle detection member 700. The control member is in communication with the angle detection member 700. The angle detection member 700 has a strip member 710 connected to a sensing positioned located on an outer facing surface of the driven gear 120, and a sensor 720 configured to sense the passing of the strip member 710. When the sensor 720 senses the passing of the strip member 710, the cable receiving slot 130 is orientated in a position adapted to receiving the cable (a position shown in FIG. 3).

With the angle detection member 700 and the control member, it is possible to set the number of rotational circles of the press 400 about the cable. Also, the shaft 100 can be controlled to return to a desired position, for example, the cable receiving position shown in FIG. 3, after the press 400 presses and sticks the label on the cable.

In an embodiment, the sensor 720 may be a photoelectric sensor, and the strip member 710 is configured to block the light path. In other embodiments, the sensor 720 may be any suitable sensor adapted to detect a current angle position and/or a number of rotational circles of the driven gear 120.

Hereafter, the press 400 and the actuator 500 will be discussed with reference to FIGS. 3-4 and 6.

In an embodiment shown in FIGS. 3-4 and 6, the foot 420 is a pressing plate having an engagement surface 420*a* facing the cable 10. The engagement surface 420*a* presses the label 20 on the cable 10 while the shaft 100 is rotated and when the press 400 is in the pressing position. In another embodiment (not shown), the press 400 may be a pressing roller having a label engagement surface facing the cable, and the pressing roller presses the label on the cable when the shaft 100 is rotated and when the press 400 is in the pressing position.

In an embodiment (not shown), the actuator 500 has an elastic body that exerts an elastic force to drive the press 400 toward the pressing position; and an electromagnetic coil and an iron core positioned on the press 400. Once the electromagnetic coil is energized, the press 400 is moved from the pressing position to the non-pressing position in a direction perpendicular to the longitudinal axis by overcoming the elastic force of the elastic body.

In the embodiments shown in FIGS. 3-4 and 6, the actuator 500 includes a link rod 510, a pivot shaft 520, an elastic body 530, and a holding member 540. The link rod 510, having a first end on which the foot 420 is fixed, has a pivot hole 512 positioned between the first end and an opposite second of the link rod 510. The pivot shaft 520 passing through the pivot hole 512. The elastic body 530 exerts an elastic force to drive the press 400 toward the pressing position. The holding member 540 (see FIG. 1) presses the second end of the link rod 510 to exert a holding force to hold the press 400 in the non-pressing position by overcoming the elastic force.

During or before the shaft 100 is rotated, the holding force is released and the press 400 is in the pressing position.

In an embodiment shown in FIG. 1, the label sticking device has a first bracket 810. The holding member 540 includes a first sliding member (indicated by 540) mounted on and slidable along the first bracket 810. The first sliding member 540 is movable between a holding position, where the first sliding member 540 presses the second of the link rod 510, and a releasing position, where the first sliding member 540 is positioned a distance away from the second end of the link rod 510. The first sliding member 540 may be driven by a gas cylinder, a hydraulic cylinder, or a motor 550.

In the embodiments shown in FIGS. 4 and 6, the body 410 includes a connecting body 412 connected to the shaft 100, and a holding body 414 connected to the connecting body 412. The holding body 414 has a guide slot 414*a* passing through the holding body 414 parallel to a moving direction of the press 400, the holding body 414 further includes a pivot shaft receiving hole 414*b* that receives and holds the pivot shaft 520. The press 400 further includes a guiding member 430 connected to the foot 420 and positioned in the guide slot 414*a*. The first end of the link rod 510 is connected to the guiding member 430. A first end of the elastic body 530 is fixed to the connecting body 412, and an opposite second end of the elastic body 530 pushes against the second end of the link rod 510.

In an embodiment shown in FIG. 4, an elastic body receiving member 412*a* is positioned on the connecting body 412. An engaging block 514 is positioned on the second end of the link rod 510, and a recess 514*a* is formed in a surface of the engaging block 514 facing the connecting body 412. The elastic body 530 is positioned between the elastic body receiving member 412*a* and the recess 514*a*.

In an embodiment, the elastic body 530 is a compressible spring or a rubber body.

In an embodiment shown in FIG. 1, a label sticking apparatus has a base seat 910; the above described label sticking device mounted on the base seat 910 through a second bracket 920; and a transition driving member 930 that drives the label sticking device to move between an idle position, where the label sticking device is separated away from the cable, and a work position, where the longitudinal axis of the cable is in conformity with the rotational axis of the shaft 100. For example, when the label sticking device is moved in a direction A, the label sticking device is moved to the idle position, and when the label sticking device is moved in a direction opposite to the direction A, the label sticking device is moved to the work position.

As shown in FIG. 1, the first bracket 810 is mounted on a third bracket 940, and the third bracket 940 is mounted on the second bracket 920.

The transition driving member 930 includes a gas cylinder, a hydraulic cylinder, or a motor 932 to drive the third bracket 940 to move along a rail on the second bracket 920.

Though it is not shown, the label sticking apparatus may further comprise a mechanical arm configured to place the label on the cable.

Hereafter, a process of sticking the label on the cable by the label sticking device will be described.

Firstly, the cable 10 is held by the cable holder 200, so that the longitudinal axis of the cable is in conformity with the rotational axis of the shaft 100 in use.

Secondly, a first end of the label 20 is placed in contact with the cable 10 (for example, as shown in FIG. 3) by, for example, the mechanical arm.

Thirdly, the third bracket 940 is driven by the transition driving member 930, to move along the rail 922 on the second bracket 920 toward the cable 10, until the longitudinal axis of the cable 10 is in conformity with the rotational axis of the shaft 100. At the same time, the foot 420 of the press 400 is positioned above the first end of the label 20 positioned on the cable 10, and the holding member 540 of the actuator 500 presses the engaging block 514 on the second end of the link rod 510. The elastic body 530 is therefore pressed, and exerts a holding force to hold the press 422 in the non-pressing position, where the press 422 is separated from the label 20 by a distance in a direction B (as shown in FIG. 4), by overcoming the elastic force of the elastic body 530.

Fourthly, the holding member 540 of the actuator 500 is driven by the gas cylinder, the hydraulic cylinder, or the motor 550, to move in the direction B, so as to release the engaging block 514 on the second of the link rod 510. In this way, the second end of the link rod 510 is pushed upward under the elastic force of the elastic body 530, the link rod 510 is rotated about the pivot shaft 520, and the foot 420 on the first end of the link rod 510 is moved to the pressing position for pressing the label 20 (as shown in FIG. 4).

Fifth, the shaft 100 is rotated by the drive 300, so as to drive the foot 420 to rotate about the rotational axis. During rotation, the foot 420 presses and wraps the label 20 on the cable. Those skilled in the art would appreciate that the foot 420 is rotated in a direction to wrap the label around the cable. Through the angle detection member 700 and the control member, the number of rotational circles of the press 400 about the cable can be controlled and preset. Further, the angle detection member 700 and the control member can control the shaft 100 to return to a position, for example, a position shown in FIG. 3, after the press 400 presses and sticks the label 20 on the cable 10.

Finally, the cable 10 wrapped with the label 20 is removed from the label sticking device.

Those skilled in the art would appreciate that the above embodiments are intended to be exemplary, and not restrictive. For example, many modifications may be made to the above embodiments by those skilled in the art, and various features described in different embodiments may be freely combined with each other without departing in configuration or principle.

Though several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A label sticking device, comprising:

a shaft having a rotational axis, and a cable receiving passageway extending along a longitudinal axis aligned with the rotational axis;

a cable holder positioned along the longitudinal axis and the rotational axis;

a drive that rotates the shaft about the rotational axis;

a press having a body rotatably connected to the shaft, and a foot positioned on the body, the foot being movable between a pressing position proximate to the rotational axis, and a non-pressing position distal to the rotational axis; and an actuator that moves the press between the pressing position and the non-pressing position.

2. The label sticking device according to claim 1, wherein:

the shaft has a cylindrical body with a driven gear, and a hollow member centrally positioned the cable receiving passageway; and the drive has a driving gear in rotational contact with the driven gear to rotate the cylindrical body.

3. The label sticking device according to claim 2, wherein the cylindrical body has a cable receiving slot extending along the longitudinal axis.

4. The label sticking device according to claim 3, wherein the driven gear has a cable receiving gear slot extending from an outer edge to an approximate center of the driven gear, the cable receiving gear slot being aligned with the longitudinal axis of cable receiving passageway, the longitudinal axis of the cable receiving slot, and with the rotational axis.

5. The label sticking device according to claim 4, wherein the drive further comprises two middle gears engaged with both the driving gear and the driven gear, the two middle gears being positioned on opposite sides, respectively, of an approximate line extending from a center of the driving gear to a center of the driven gear.

6. The label sticking device according to claim 2, further comprising a bearing member mounted on the cylindrical body of the shaft to rotatably support the cylindrical body, and having an approximate center positioned on the longitudinal axis a distance from the center of the driven gear on the longitudinal axis.

7. The label sticking device according to claim 1, further comprising:

an elastic body angle detection member that detects a current angle position of the shaft or a number of rotational circles made by the shaft; and a control member in communication with the elastic body angle detection member and in operable control of the drive.

8. The label sticking device according to claim 4, further comprising:

an angle detection member that detects a current angle position of the shaft or a number of rotational circles of the shaft from starting, the angle detection member having a strip member detecting sensor, and a strip member connected to a sensing position on the driven gear and radially extending to an outside of the driven gear, such that when the sensing position of the driven gear is aligned with the strip member detecting sensor, the cable receiving slot is in a cable receiving position; and a control member in communication with the angle detection member and in operable control of the drive.

9. The label sticking device according to claim 1, wherein the foot has a pressing plate with a label engagement surface.

10. The label sticking device according to claim 1, wherein the press has a pressing roller with a label engagement surface.

11. The label sticking device according to claim 1, wherein the actuator includes:

an elastic body that exerts an elastic driving force on the press toward the pressing position; and an electromagnetic coil and an iron core positioned on the press.

12. The label sticking device according to claim 11, wherein when the electromagnetic coil is energized, the press overcomes the elastic driving force of the elastic body to move from the pressing position to the non-pressing position in a direction perpendicular to the longitudinal axis.

13. The label sticking device according to claim 1, wherein the actuator includes:

a link rod having a first end on which the press is fixed and an opposite second end;

a pivot hole positioned between the first end and the second end of the link rod;

a pivot shaft passing through the pivot hole;

an elastic body exerting an elastic driving force on the press toward the pressing position; and a holding member pressing the second end of the link rod to exert a holding force greater than the elastic driving force to hold the press in the non-pressing position.

14. The label sticking device according to claim 13, wherein during or before the shaft is rotated, the holding force is released and the press is in the pressing position.

15. The label sticking device according to claim 14, further comprising a first bracket; and the holding member includes a first sliding member slidably mounted on the first bracket, the first sliding member being movable between a holding position where the first sliding member presses the second end of the link rod, and a releasing position where the first sliding member is positioned a distance away from the second end of the link rod.

16. The label sticking device according to claim 15, wherein the first sliding member is driven by a gas cylinder, a hydraulic cylinder or a motor.

17. The label sticking device according to claim 13, wherein the elastic body is positioned on the second end of the link rod.

18. The label sticking device according to claim 17, wherein the body includes:

a connecting body connected to the shaft and to the first end of the elastic body; and a holding body connected to the connecting body, and having a guide slot passing through the holding body parallel to a moving direction of the press, and a pivot shaft receiving hole into which the pivot shaft is positioned;

a guiding member positioned in the guide slot and connected to the press and the first end of the link rod.

19. The label sticking device according to claim 18, wherein the second end of the elastic body exerts an elastic driving force against the second end of the link rod.

20. The label sticking device according to claim 19, further comprising:

an elastic body receiving member positioned on the connecting body;

an engaging block positioned on the second end of the link rod; and a recess positioned a surface of the engaging block facing the connecting body, such that the elastic body is positioned between the elastic body receiving member and the recess.

21. A label sticking apparatus for sticking a label around a cable, comprising:

a base seat;

the label sticking device mounted on the base seat through a second bracket, the label sticking device having a shaft having a rotational axis, and a cable receiving passageway extending along a longitudinal axis aligned with the rotational axis, a cable holder positioned along the longitudinal axis and the rotational axis, a drive that rotates the shaft about the rotational axis, a press having a body rotatably connected to the shaft, and a foot positioned on the body, the foot being movable between a pressing position proximate to the rotational axis, and a non-pressing position distal to the rotational axis, and an actuator that moves the press between the pressing position and the non-pressing position; and a transition driving member that movably drives the label sticking device between an idle position defined by the longitudinal axis being out of conformity with the rotational axis, and a work position defined by the longitudinal axis being in conformity with the rotational axis.

* * * * *